US008739472B2

(12) United States Patent
Moss

(10) Patent No.: US 8,739,472 B2
(45) Date of Patent: Jun. 3, 2014

(54) RETENTION CLIP, MOVABLE PARTITION SYSTEM, AND METHOD FOR RESTRICTING MOVEMENT OF ADJACENT PANELS OF A MOVABLE PARTITION SYSTEM

(75) Inventor: Anthony Moss, Salt Lake City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 60 days.

(21) Appl. No.: 13/085,707

(22) Filed: Apr. 13, 2011

(65) Prior Publication Data

US 2012/0260578 A1 Oct. 18, 2012

(51) Int. Cl.
*E04B 1/346* (2006.01)
*E04B 7/16* (2006.01)

(52) U.S. Cl.
USPC ..... 52/71; 160/199

(58) Field of Classification Search
USPC ..... 52/71, 238.1, 243.1; 160/199, 229.1; 24/289, 290
See application file for complete search history.

(56) References Cited

U.S. PATENT DOCUMENTS 2,226,368 A * 12/1940 Burson ..... 52/285.3
3,019,836 A * 2/1962 Leigh ..... 160/199
4,228,841 A * 10/1980 Dixon ..... 160/183
6,047,508 A * 4/2000 Goodman et al. ..... 52/241
6,546,675 B1 * 4/2003 Adderton ..... 52/71
6,601,637 B2 * 8/2003 Toti ..... 160/199
7,533,502 B2 * 5/2009 Siegel ..... 160/200
7,886,804 B2 * 2/2011 Goodman et al. ..... 160/199
2007/0294945 A1 * 12/2007 Coleman et al. ..... 49/103
2008/0244991 A1 * 10/2008 Coleman et al. ..... 52/71
2012/0138242 A1 6/2012 Kondash et al.

OTHER PUBLICATIONS

Smart, R. Scott, U.S. Appl. No. 12/712,922, filed Feb. 24, 2010, and entitled "Folding Partitions Having Adjoining Panels and Related Methods".

* cited by examiner

*Primary Examiner* — Brian Glessner
*Assistant Examiner* — Paola Agudelo
(74) *Attorney, Agent, or Firm* — TraskBritt

(57) ABSTRACT

A retention clip for a movable partition includes a top portion and a base portion. The top portion includes an elongated member having a top surface and a bottom surface. The base portion includes an elongated member having a front surface, a back surface, and a side surface. The base portion further includes an extended side portion extending at an angle relative the front surface. A related movable partition system includes a plurality of interconnected panels, a first retention clip and a second retention clip connected to one of the plurality of interconnected panels proximate a first interface and a second interface. A related method for restricting relative movement of adjacent panels of a movable partition includes connecting a first retention clip and a second retention clip each having an extended side portion extending at an angle from a base portion proximate an interface between a pair of adjacent panels.

22 Claims, 11 Drawing Sheets

RETENTION CLIP, MOVABLE PARTITION SYSTEM, AND METHOD FOR RESTRICTING MOVEMENT OF ADJACENT PANELS OF A MOVABLE PARTITION SYSTEM

TECHNICAL FIELD

Embodiments of the disclosure are directed to the field of partitions used for partitioning space, as sound barriers, as fire barriers, security barriers, and for various other applications.

BACKGROUND

Movable partitions are used in numerous environments for a variety of purposes. Such movable partitions may be used to temporarily divide a single large room into two or more smaller rooms. In other applications, such partitions may be used for noise control depending, for example, on the activities taking place in a given room or portion thereof. Movable partitions may also be used to provide a security barrier, a fire barrier, or both a security barrier and a fire barrier. In such situations, the movable partition may be configured to automatically close upon the occurrence of a predetermined event, such as the actuation of an associated alarm. For example, a movable partition may be configured as one or more collapsible doors (e.g., accordion or similar folding-type partitions), wherein each movable partition may be formed with a plurality of panels connected (i.e., coupled) to one another. The construction of the panels allows the partition to retract (e.g., fold, collapse, etc.) into a compact unit for purposes of storage. The movable partition may be stored in a pocket formed in the wall of a building when in a retracted (e.g., folded) state.

The movable partition may be deployed by being extended to a desired distance along an overhead track that may be located above the movable partition in a header assembly. A leading end of the movable partition may complementarily engage another structure, such as a wall, a post, or another door. The leading end of the movable partition may also be referred to as a "lead post."

In some situations, the movable partition may be extended and retracted manually or automatically. Automatic extension and retraction of the movable partition may be accomplished through the use of a motor. The motor may be located in a pocket formed in the wall of a building in which the movable partition is stored while in a retracted or folded state. The motor may remain fixed in place within the pocket, and may be used to drive extension and retraction of the movable partition along the overhead track. The motor may also be located within the movable partition itself, such that the motor travels with the movable partition as the movable partition is extended and retracted along the overhead track.

The panels of the movable partition may become disengaged from each other while the movable partition is being extended, retracted, or in other situations in which a force may cause the panels to separate from one another. If the panels become disengaged, the movable partition may fail to move properly along the overhead track.

DETAILED DESCRIPTION

Illustrations presented herein are not meant to be actual views of any particular movable partition system, or component of a movable partition system, but are merely idealized representations that are employed to describe embodiments of the present disclosure. Additionally, elements common between figures may retain the same or similar numerical designation.

It should be understood that any reference to an element herein using a designation such as "first," "second," "third," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

Figure 1:
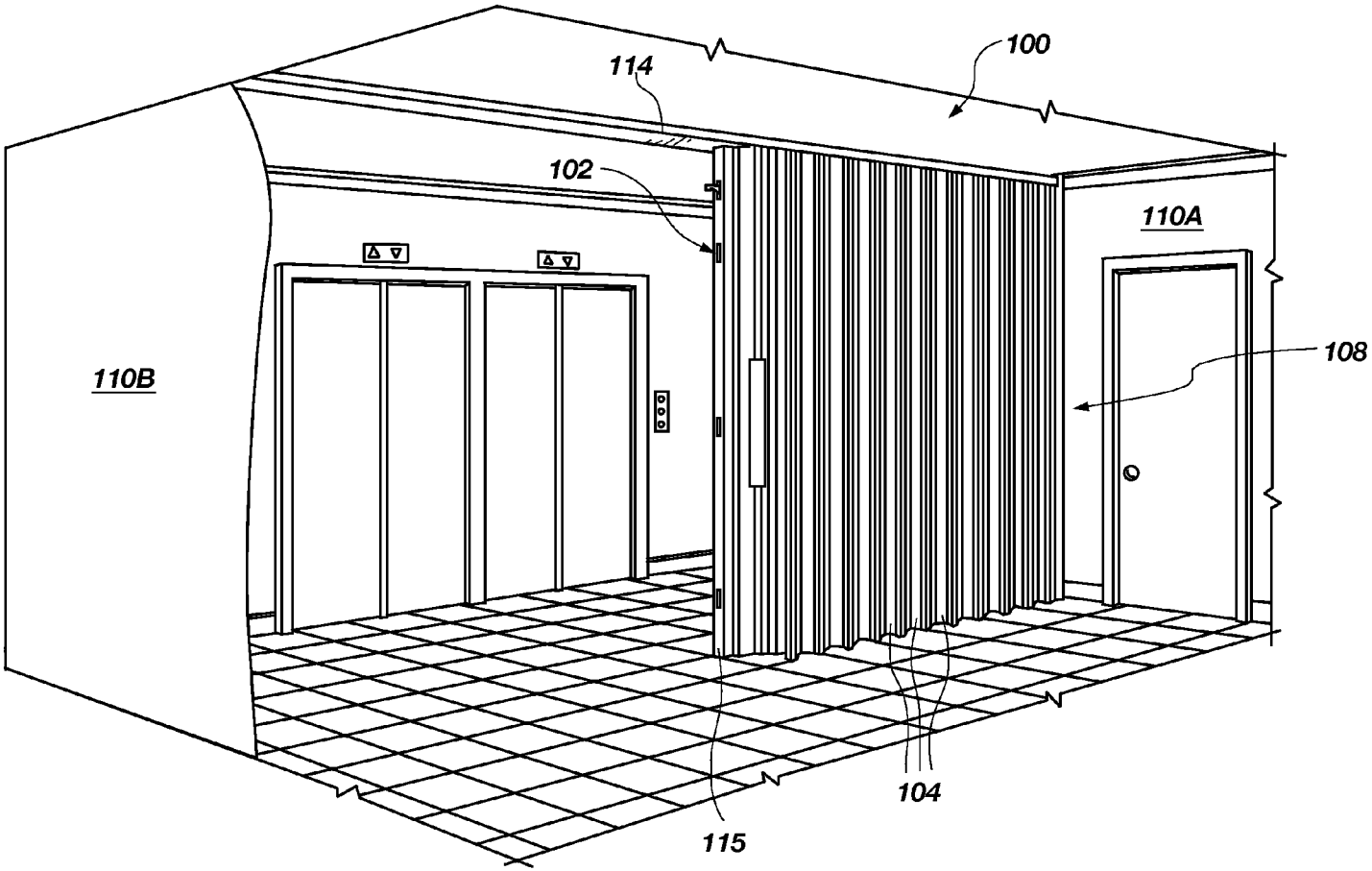
FIG. 1 illustrates a movable partition system according to an embodiment of the present disclosure.

FIG. 1 illustrates a movable partition system 100 according to an embodiment of the present disclosure. The movable partition system 100 comprises a movable partition 102. The movable partition 102 may be used for partitioning space, as a sound barrier, as a fire barrier, as a security barrier, for combinations of such purposes, or for other purposes. The movable partition 102 may be engaged with a track 114, along which the movable partition 102 may be extended and retracted. The track 114 may be an overhead track that is mounted to a ceiling or a door header of a building. Thus, the movable partition 102 may be engaged with the track 114 by being suspended from (i.e., hung from) the track 114 in some embodiments.

The movable partition 102 comprises a plurality of panels 104 that may be arranged in sheets. Therefore, the plurality of panels 104 may also be referred to herein as a sheet of panels 104. The movable partition 102 may include one or more sheets of panels 104, such as two sheets of panels 104 that are arranged side-by-side and move together along the track 114. In some embodiments, at least some of the plurality of panels 104 are directly connected to one or more adjacent and adjoining panels within the sheet of panels 104 without the use of a hinge member therebetween. The panels 104 in each sheet are connected to one another in such a manner so as to permit the panels to fold back and forth relative to one another in an accordion fashion such that the movable partition 102 may collapse (e.g., fold) as the movable partition 102 is retracted.

In operation, the movable partition 102 may be deployed to an extended position by driving the movable partition 102 along the track 114 across the space to provide an appropriate barrier. The movable partition 102 may be extended and retracted between a wall 110A and another wall 110B of a building. Collapsing the panels 104 of the movable partition 102 may further permit the movable partition 102 to be compactly stored in a pocket 108 formed in the wall 110A of a building if the movable partition 102 is in a retracted (i.e., opened) state. The movable partition system 100 may be an automatic movable partition system, in that the movable partition 102 may be automatically extended and automatically retracted. The movable partition system 100 may comprise a motor (not shown), for example, to drive movement of the movable partition 102 between the extended and retracted states. In some embodiments, the movable partition 102 may manually extended and retracted, while in some embodiments, the movable partition 102 may be operated either automatically or manually.

The movable partition 102 may further include a lead post 115 connected to a leading end of the one or more sheets of panels 104. The lead post 115 may be configured to complementarily engage with a striker (e.g., jamb, door post, etc.) that may be provided in the another wall 110B of a building when the movable partition 102 is in an extended (i.e., closed) state. While the embodiment of the movable partition system 100 of FIG. 1 includes a single movable partition 102, the movable partition system 100 may comprise more than one movable partition 102 in further embodiments of the disclosure. For example, another movable partition (not shown) may extend from the another wall 110B of the building toward the wall 110A such that the another movable partition may meet and complimentarily engage with the movable partition 102 at a position along an intermediate portion of the track 114.

Figure 2:
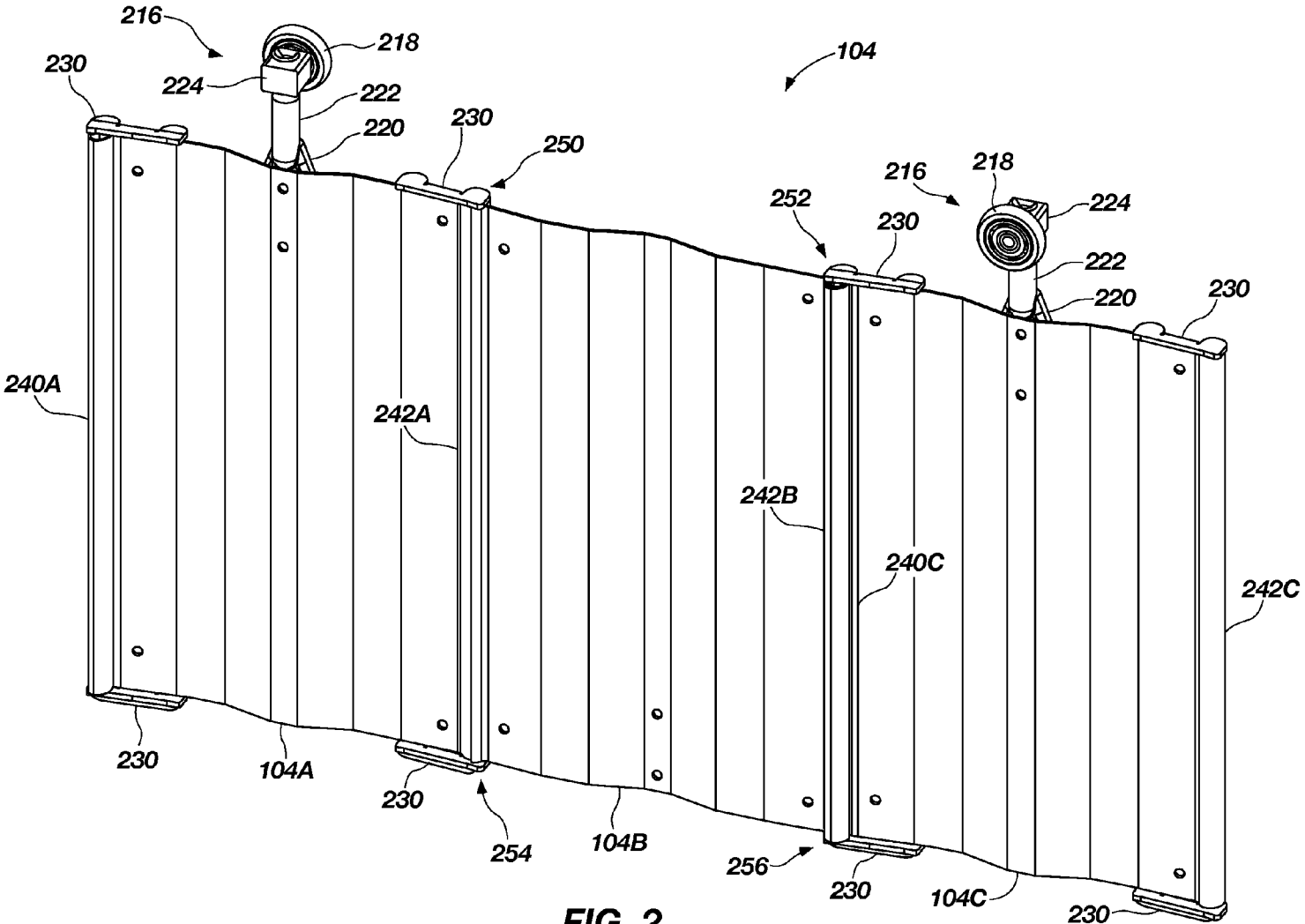
FIG. 2 is a simplified illustration of a portion of a sheet of panels of the movable partition of FIG. 1.

FIG. 2 is a simplified illustration of a portion of a sheet of panels 104 of the movable partition 102 of FIG. 1. The portion of the sheet of panels 104 shown in FIG. 2 includes a first panel 104A, a second panel 104B, and a third panel 104C (collectively, "panels 104A, 104B, 104C"). The height of each of the panels 104A, 104B, 104C has been reduced in FIG. 2 (as well as in other figures herein), such that the various illustrated components may not be to scale, in order to facilitate illustration and description of the various features of the sheet of panels 104 as related to other components described herein.

Each of the panels 104A, 104B, and 104C has a first lateral end and a second lateral end opposite the first lateral end. For example, the first panel 104A includes first lateral end 240A and second lateral end 242A, the second panel 104B includes first lateral end 240B and second lateral end 242B, and the third panel 104C includes first lateral end 240C and second lateral end 242C. The second lateral end 242A of the first panel 104A is directly adjoined to the first lateral end 240B of the adjacent second panel 104B, and the second lateral end 242B of the second panel 104B is directly adjoined to the first lateral end 240C of the third panel 104C.

The sheet of panels 104 may be connected to a plurality of roller assemblies 216 that facilitate attachment of the movable partition 102 to the track 114 (FIG. 1). Thus, the plurality of roller assemblies 216 may enable the movable partition 102 to be suspended from (i.e., hung from) the track 114. In other words, the roller assemblies 216 are engaged with and supported by the track 114, and the movable partition 102 is connected to and supported by the roller assemblies 216. Each of the roller assemblies 216 may include a bracket 220 that is connected to a panel (e.g., panel 104A, panel 104C in FIG. 2). The bracket 220 may be connected to a panel using, for example, one or more fasteners (e.g., rivets, bolts, screws, etc.). In some embodiments, the bracket 220 may be connected to a panel in another manner, such as being welded, or by using an adhesive. The bracket 220 may include an elongated pin member 222 that is connected to a hub 224. The hub 224 may be configured to rotate about the pin member 222 of the bracket 220. Each roller assembly 216 may further include one or more rollers 218 (e.g., wheels). The rollers 218 may be connected to the hub 224. The rollers 218 are configured to be positioned in and supported by a roller channel (not shown) of the track 114, the rollers 218 assisting in moving the movable partition 102 along the track 114 during extension or retraction of the movable partition 102.

One or more retention clips 230 may be connected to the sheet of panels 104, for example, proximate interfaces between adjacent panels. For example, a retention clip 230 may be connected to sheet of panels 104 proximate an interface between the first panel 104A and the second panel 104B, such as proximate top location 250 of the interface. Another retention clip 230 may be connected to the sheet of panels 104 proximate the interface between the second panel 104B and the third panel 104C, such as proximate top location 252 of the interface. Another retention clip 230 may be connected to the sheet of panels 104 proximate a bottom location 254 of the interface between the first panel 104A and the second panel 104B. Another retention clip 230 may be connected to the sheet of panels 104 proximate a bottom location 256 of the interface between second panel 104B and third panel 104C. Other retention clips 230 are illustrated in FIG. 2 as being connected to the sheet of panels 104 proximate locations where interfaces of adjacent panels are not shown in FIG. 2, such as proximate the first lateral end 240A of the first panel 104A or the second lateral end 242C of the third panel 104C. Of course, as FIG. 2 may illustrate only a portion of a sheet of panels 104, additional panels may exist that are connected to the first panel 104A or the third panel 104C, such that the locations for the other retention clips 230 may also be proximate an interface between adjacent panels.

The retention clips 230 may be configured such that panels 104A, 104B, 104C are prevented from separating (i.e., decoupling) from each other by restricting movement of the panels 104A, 104B, 104C relative one another in a direction that would decouple the adjoining lateral ends of one or more of the panels 104A, 104B, 104C. The retention clips 230 may also be configured to restrict movement of the adjoining lateral ends of the panels 104A, 104B, 104C relative one another along a vertical direction. All references to "vertical" herein refer to the direction that is generally orthogonal to the direction of movement of the sheet of panels 104 during normal operation. Reference to the "transverse" direction are made to a direction that would cause adjoining lateral ends of the panels 104A, 104B, 104C to decouple in a direction that is not the vertical direction. As the sheet of panels 104 fold, the transverse direction may change depending on the openings and orientation of the adjacent panels 104. For example, if the vertical direction is defined as the "Y" direction, the transverse direction may be a direction that has components in the "X" and "Z" directions. In other words, while the transverse direction may be generally in the direction of movement of the sheet of panels 104 during normal operation, the direction may be understood to be relative to adjacent panels, and the movement therebetween that would cause a decoupling of the adjacent panels in a non-vertical direction. The retention clips 230 will be described in further detail below with reference to FIGS. 9 and 10.

Figure 3:
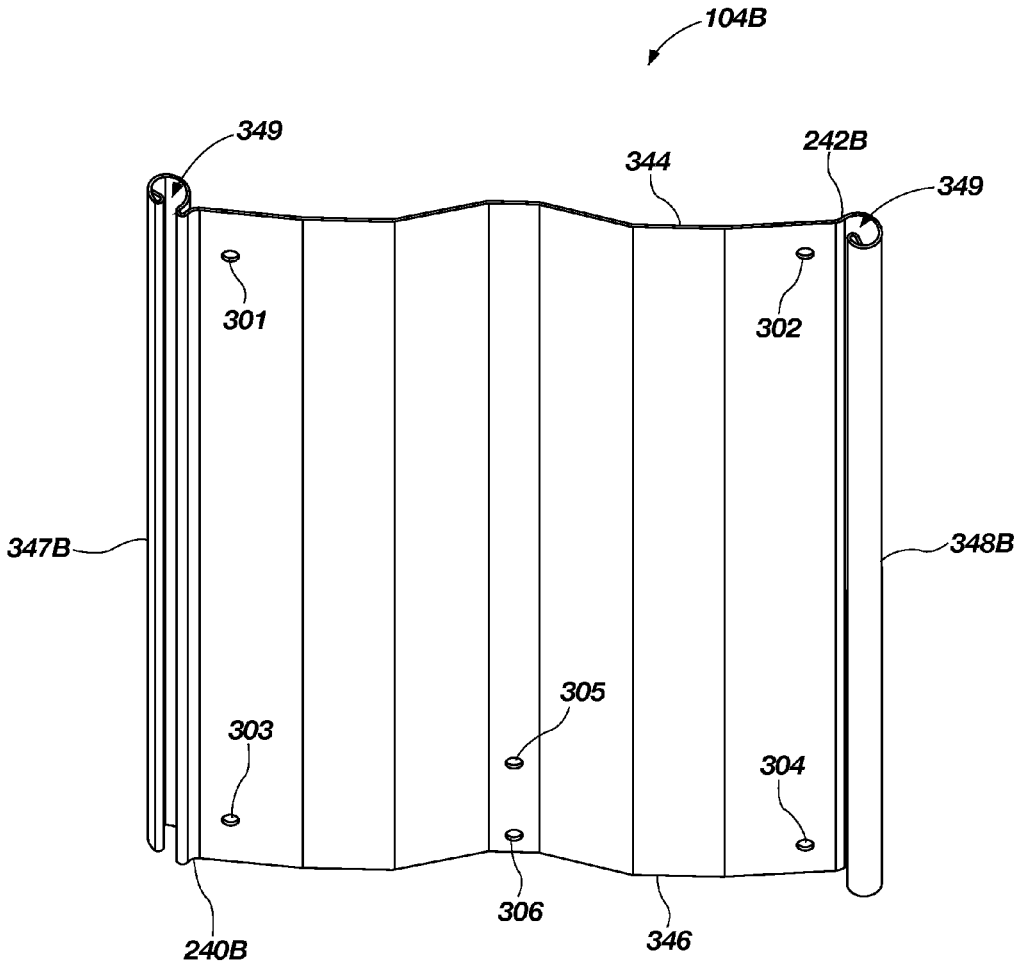
FIG. 3 illustrates a panel of the sheet of panels of FIG. 2.

FIG. 3 illustrates a panel 104B of the sheet of panels 104 of FIG. 2. For example, the second panel 104B of FIG. 2 is shown in FIG. 3 for convenience of retaining the numerical designation thereof; however, the first panel 104A and the third panel 104C of FIG. 2, as well as other panels in the sheet of panels 104 of FIG. 1, may be similarly configured, formed, and shaped.

The first lateral end 240B may comprise a first generally cylindrical structure 347B, and the second lateral end 242B may comprise a second generally cylindrical structure 348B. The first generally cylindrical structure 347B and the second generally cylindrical structure 348B may not form a complete cylinder, such that an opening 349 (e.g., a slit or a gap) extends linearly along a longitudinal length of each of the first and second generally cylindrical structures 347B, 348B from a top edge 344 of the second panel 104B to a bottom edge 346 of the second panel 104B. The first and second generally cylindrical structures 347B, 348B facilitate connecting adjacent panels (e.g., first panel 104A and third panel 104C). As previously discussed with respect to FIG. 2, the first lateral end 240B of the second panel 104B is configured to engage (i.e., couple, connect) with the second lateral end of an adjacent panel (e.g., first panel 104A of FIG. 2), and the second lateral end 242B of the panel 104B is configured to engage with the first lateral end of another adjacent panel (e.g., third panel 104C of FIG. 2).

The second panel 104B may further include apertures 301-306 formed therethrough. The apertures 301-304 may align with apertures of the retention clips 230 (FIG. 2) to connect the retention clips 230 thereto, such as through the use of an appropriate fastener. Thus, the apertures 301-304 may be positioned at locations on the second panel 104B so as to properly position the retention clips 230 (e.g., retention clips 230A, 230B of FIGS. 9, 10). For some embodiments, the apertures 301-304 may align with apertures of a profile clip 1250 (FIGS. 12, 13) so as to properly position the profile clip 1250.

The apertures 301, 302 may be offset from each other in that the aperture 302 is located at a higher location on the second panel 104B relative to the location of the aperture 301. Likewise, the apertures 303, 304 may be offset from each other. Such an offset configuration may cause the fasteners (e.g., rivets) of adjacent panels from contacting each other if the movable partition 102 is collapsed. As a result, the movable partition 102 may be more compact in a collapsed state than if the apertures 301, 302 were not offset. Of course, other configurations are apparent to those of ordinary skill in the art to avoid contact with each other including having the apertures 301, 302 aligned with each other, while similar apertures on adjacent panels may be offset from the aligned apertures 301, 302; however, offsetting apertures on the same panel may result in the movable partition 102 being constructed from identical panels, which may result in reduced manufacturing and assembly costs associated with having one panel configuration.

Figure 12:
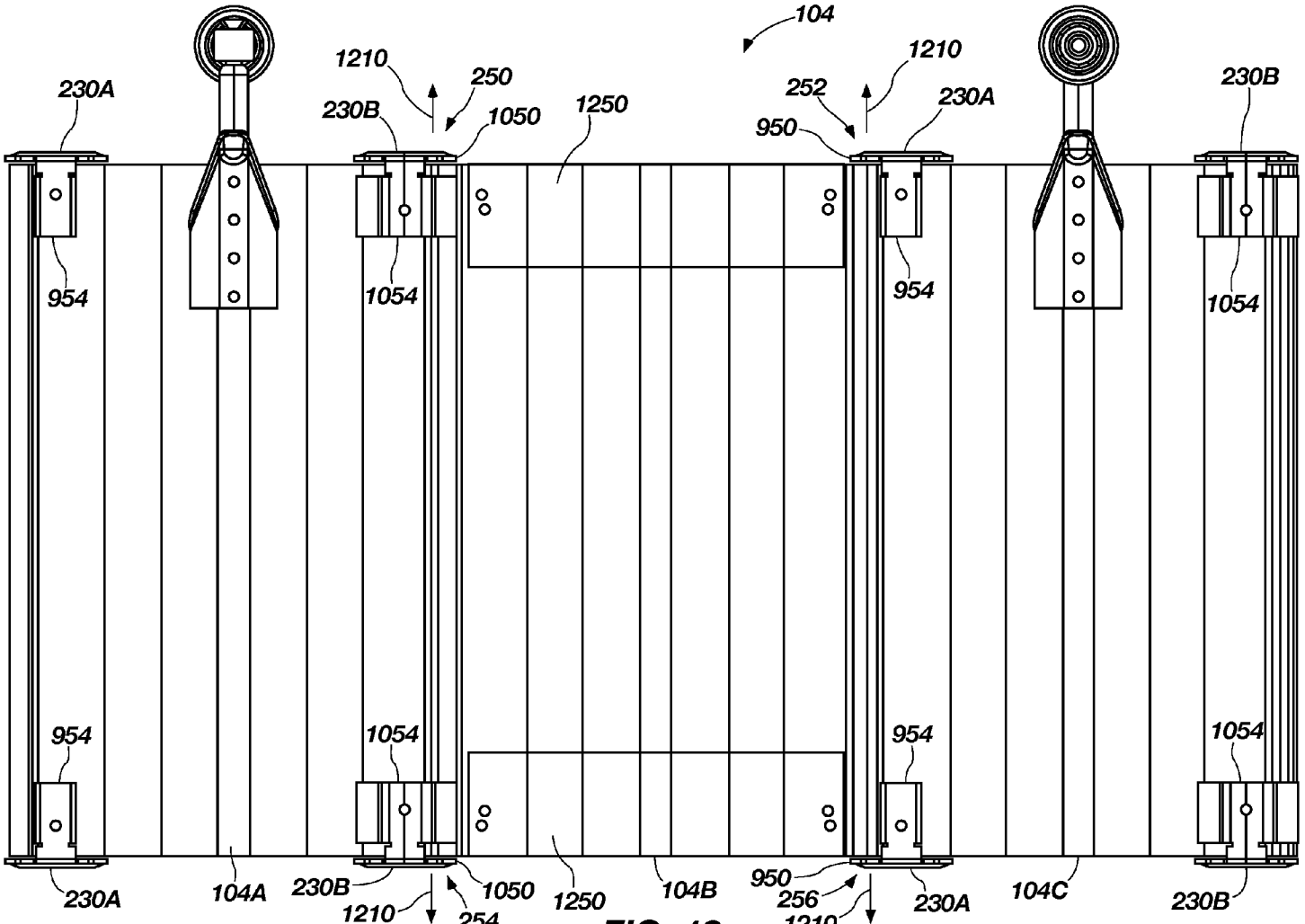
FIG. 12 is a side view of the portion of a sheet of panels of FIG. 2 in an extended state with retention clips mounted thereon.

The apertures 305, 306 may align with apertures of the bracket 220 of the roller assemblies 216 (FIG. 2) to connect the roller assemblies 216 thereto. Thus, the apertures 305, 306 may be positioned at locations on the second panel 104B so as to properly position the roller assemblies 216. It is, of course, noted that the second panel 104B is illustrated to not have a roller assembly connected thereto (see FIG. 2); however, such apertures may be used for panels (e.g., panels 104A, 104C) that are connected to a roller assembly 216. As is shown in FIG. 12, these apertures 305, 306 may be blocked by a profile clip 1250 and a corresponding sweep material (not shown) that provides a seal for the movable partition 102.

Referring still to FIG. 3, the second panel 104B may be formed from a sheet of material that has been shaped to form a desired shape. For example, the second panel 104B may be extruded or otherwise formed to the desired shape, or they may be formed as a generally planar sheet of material and subsequently shaped using a process such as, for example, stamping, bending, extruding, roll forming, or combinations of such processes. The second panel 104B may comprise, for example, a metal material (such as an iron or aluminum alloy), a polymer material, or a composite material (e.g., an epoxy material reinforced with glass or carbon fibers).

Figure 4:
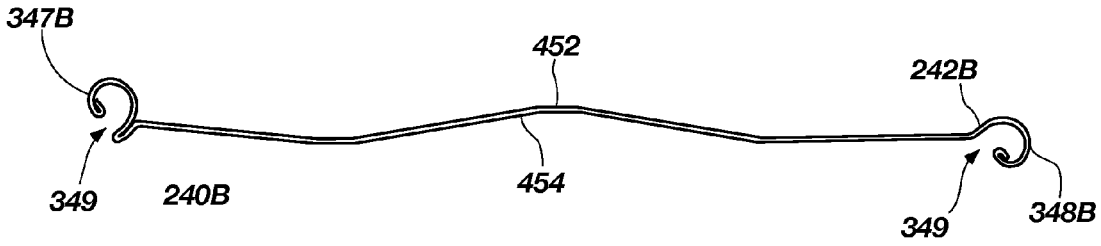
FIG. 4 is a top view of the panel of FIG. 3.

FIG. 4 is a top view of the panel 104B of FIG. 3, retaining the numerical designation of the second panel 104B. The top view of the second panel 104B shows a first major surface 452 and a second major surface 454 of the second panel 104B. The retention clips 230 (FIG. 2) may be connected to one of the first major surface 452 and the second major surface 454 of the second panel 104B. In a movable partition system 100 (FIG. 1) that includes more than one sheet of panels 104, two sheets of panels 104 may be arranged side-by-side, such that one of the first and second major surfaces 452, 454 may be visible while the other is concealed. For example, the first major surface 452 may be visible to a person within the room as the outer major surface, while the second major surface 454 may be concealed to a person within the room as the inner major surface to the sheet of panels 104.

The first generally cylindrical structure 347B and the second generally cylindrical structure 348B may be configured such that the openings 349 are generally in a similar angular position in a plane (e.g., the XY plane) oriented perpendicular to an axis extending between the top edge 344 and the bottom edge 346 of the second panel 104B. For example, the openings 349 may be in a common angular quadrant in the plane (e.g., the third quadrant extending from 180° to 270° in the positive, counterclockwise direction from the X axis shown in FIG. 5) oriented perpendicular to an axis extending between the top edge 344 and the bottom edge 346 of the second panel 104B. The first and second generally cylindrical structures 347B, 348B are configured such that the second generally cylindrical structure 348B fits within a first generally cylindrical structure of another panel (see, e.g., first generally cylindrical structure 348A of FIG. 7). Likewise, the first generally cylindrical structure 347B is configured to receive a second cylindrical structure of another panel (see, e.g., second generally cylindrical structure 348B of FIG. 7). As the sheet of panels 104 collapse (i.e., rotate to a collapsed position), the "receiving" generally cylindrical structure may switch. In other words, as the sheet of panels 104 collapse, the second generally cylindrical structure 348B may receive the first generally cylindrical structure 348A of the adjacent panel 104, such that the first generally cylindrical structure 347B fits within the second generally cylindrical structure 348B.

Figure 5:
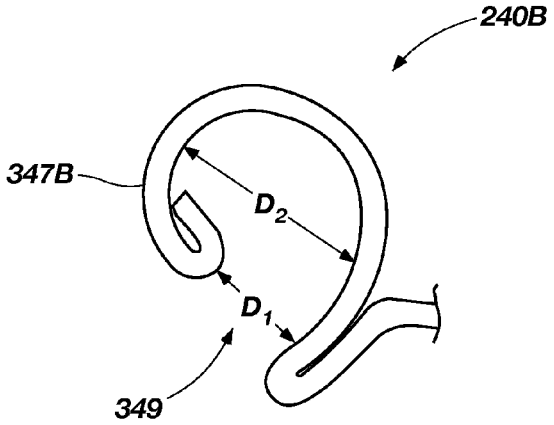
FIG. 5 is an enlarged top view of a first lateral end of the second panel shown in FIGS. 3 and 4.

FIG. 5 is an enlarged top view of the first lateral end 240B of the panel 104B shown in FIGS. 3 and 4. The shortest distance $D_1$ across the opening 349 to the first generally cylindrical structure 347B of the first lateral end 240B may be between about twenty percent (20%) and about sixty percent (60%) (e.g., about fifty percent (50%)) of an average diameter $D_2$ of the first generally cylindrical structure 347B of the first lateral end 240B. As a non-limiting example, the average diameter $D_2$ of the first generally cylindrical structure 347B of the first lateral end 240B may be between about four millimeters (4 mm) and about nine millimeters (9 mm), and the shortest distance $D_1$ across the opening 349 of the first generally cylindrical structure 347B of the first lateral end 240B may be between about two millimeters (2 mm) and about five millimeters (5 mm).

Figure 6:
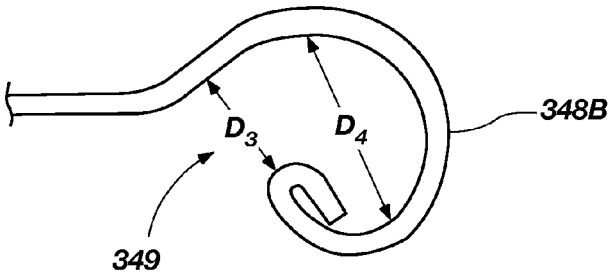
FIG. 6 is an enlarged top view of a second lateral end of the second panel shown in FIGS. 3 and 4.

FIG. 6 is an enlarged top view of the second lateral end 242B of the second panel 104B shown in FIGS. 3 and 4. The shortest distance $D_3$ across the opening 349 of the second generally cylindrical structure 348B of the second lateral end 242B may be between about twenty-five percent (25%) and about sixty-five percent (65%) (e.g., about fifty-five percent (55%)) of an average diameter $D_4$ of the second generally cylindrical structure 348B of the second lateral end 242B. As a non-limiting example, the average diameter $D_4$ of the second generally cylindrical structure 348B of the second lateral end 242B may be between about three millimeters (3 mm) and about eight millimeters (8 mm), and the shortest distance $D_3$ across the opening 349 to the second generally cylindrical structure 348B of the second lateral end 242B may be between about one and a half millimeters (1.5 mm) and about four and a half millimeters (4.5 mm).

Figure 7:
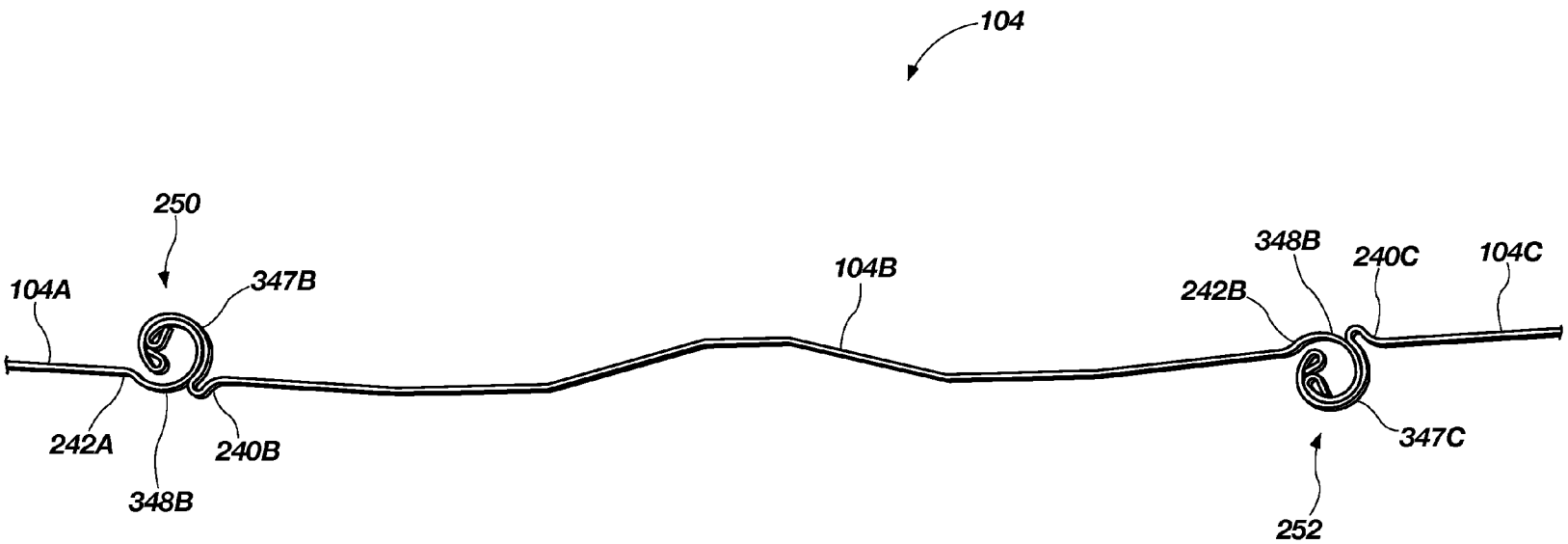
FIG. 7 is a top view of the sheet of panels of FIG. 2 in an extended state.
Figure 8:
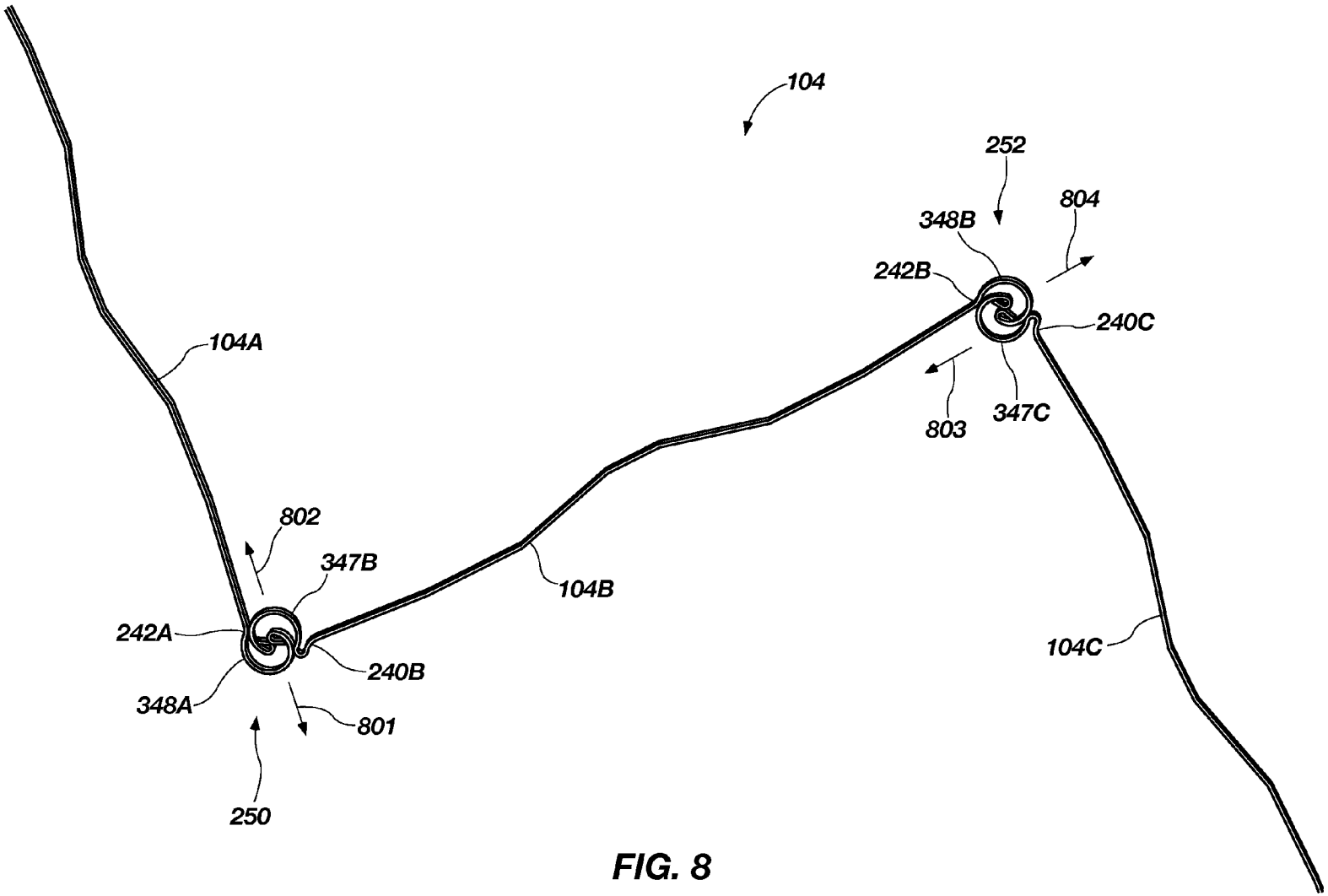
FIG. 8 is a top view of the sheet panels of FIG. 2 in a partially retracted state.

FIGS. 7 and 8 are top views of the portion of a sheet of panels 104 of FIG. 2. FIG. 7 is a top view of the sheet of panels 104 in an extended state, and FIG. 8 is a top view of the sheet of panels 104 in a partially retracted state. As shown in FIGS. 7 and 8, the first panel 104A is connected to the second panel 104B, and the second panel 104B is connected to the third panel 104C. In particular, the second lateral end 242A of the first panel 104A is connected to the first lateral end 240B of the second panel 104B, and the second lateral end 242B of the second panel 104B is connected to the first lateral end 240C of the third panel 104C. Connecting adjacent panels may occur by positioning a generally cylindrical structure of one panel within a generally cylindrical structure of another panel. For example, a second generally cylindrical structure 348A of the first panel 104A may be received by the first generally cylindrical structure 347B of the second panel 104B. Likewise, the second generally cylindrical structure 348B of the second panel 104B may be received by the first generally cylindrical structure 347C of the third panel 104C. The "receiving" generally cylindrical structure may switch as the sheet of panels 104 collapse. The retention clips 230 of FIG. 2 are not illustrated in FIGS. 7 and 8 in order to illustrate a situation that may potentially occur if the retention clips 230 were not present.

Referring now specifically to FIG. 8, if the movable partition 102 (FIG. 1) is retracted, the sheet of panels 104 may begin to collapse (i.e., fold), for example, in an accordion-type manner. At each interface between adjacent panels, the panels may begin to disengage with each other. For example, at the interface between the first panel 104A and the second panel 104B (e.g., near the top location 250), the first and second panels 104A, 104B may begin to separate. As a result, if a force is applied to the first panel 104A relative to the second panel 104B in a transverse direction (indicated by arrows 801, 802), the connection between the first panel 104A and second panel 104B may be disengaged. Similarly, applying a force on either one of the second panel 104B or the third panel 104C relative to each other in a transverse direction (indicated by arrows 803, 804) may cause the connection between the second panel 104B and the third panel 104C to be disengaged. Disengaging any of panels 104A, 104B, and 104C may cause a failure in the operation of the movable partition 102.

Figure 9:
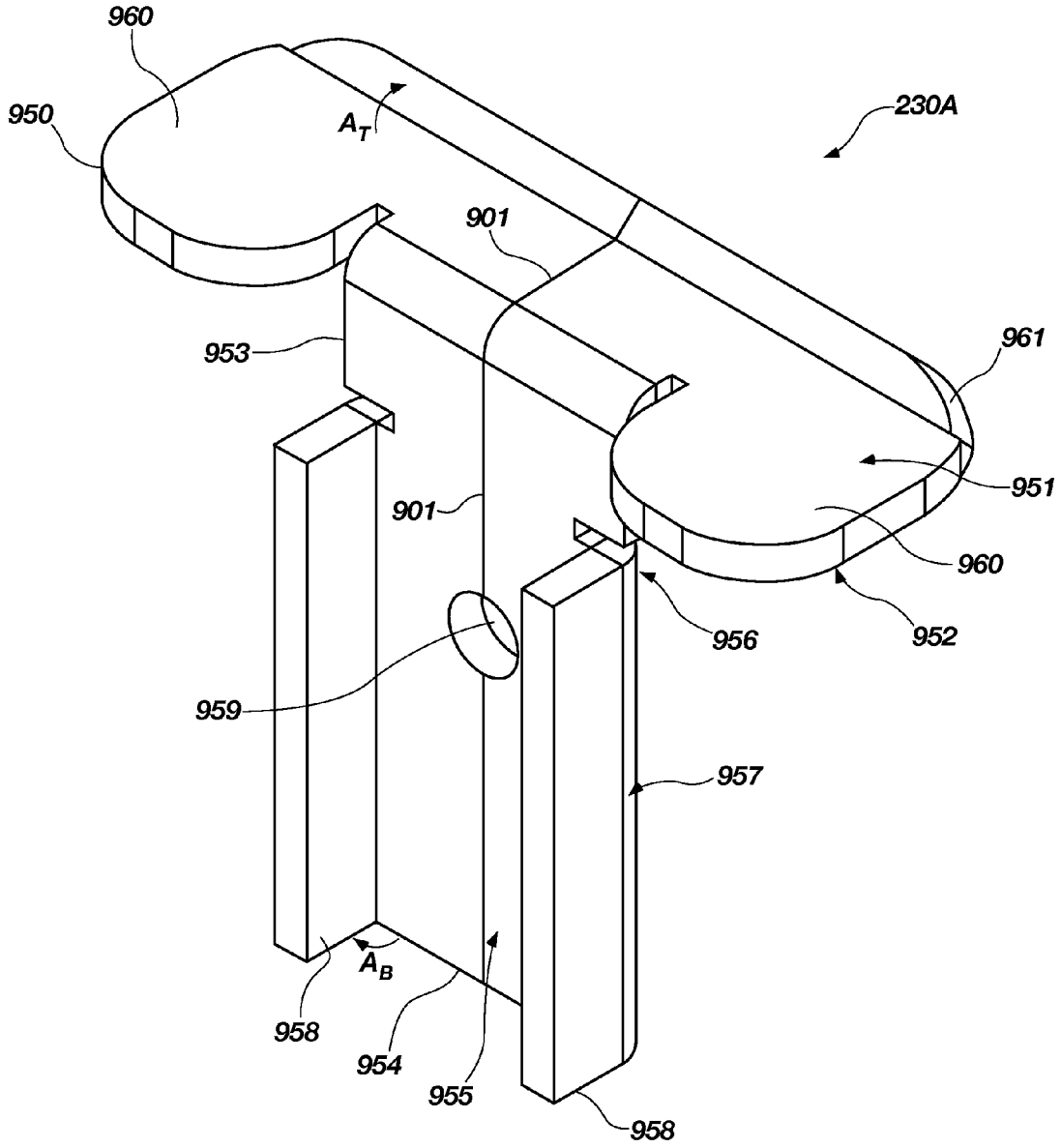
FIG. 9 is a perspective view of a retention clip according to an embodiment of the present disclosure.
Figure 10:
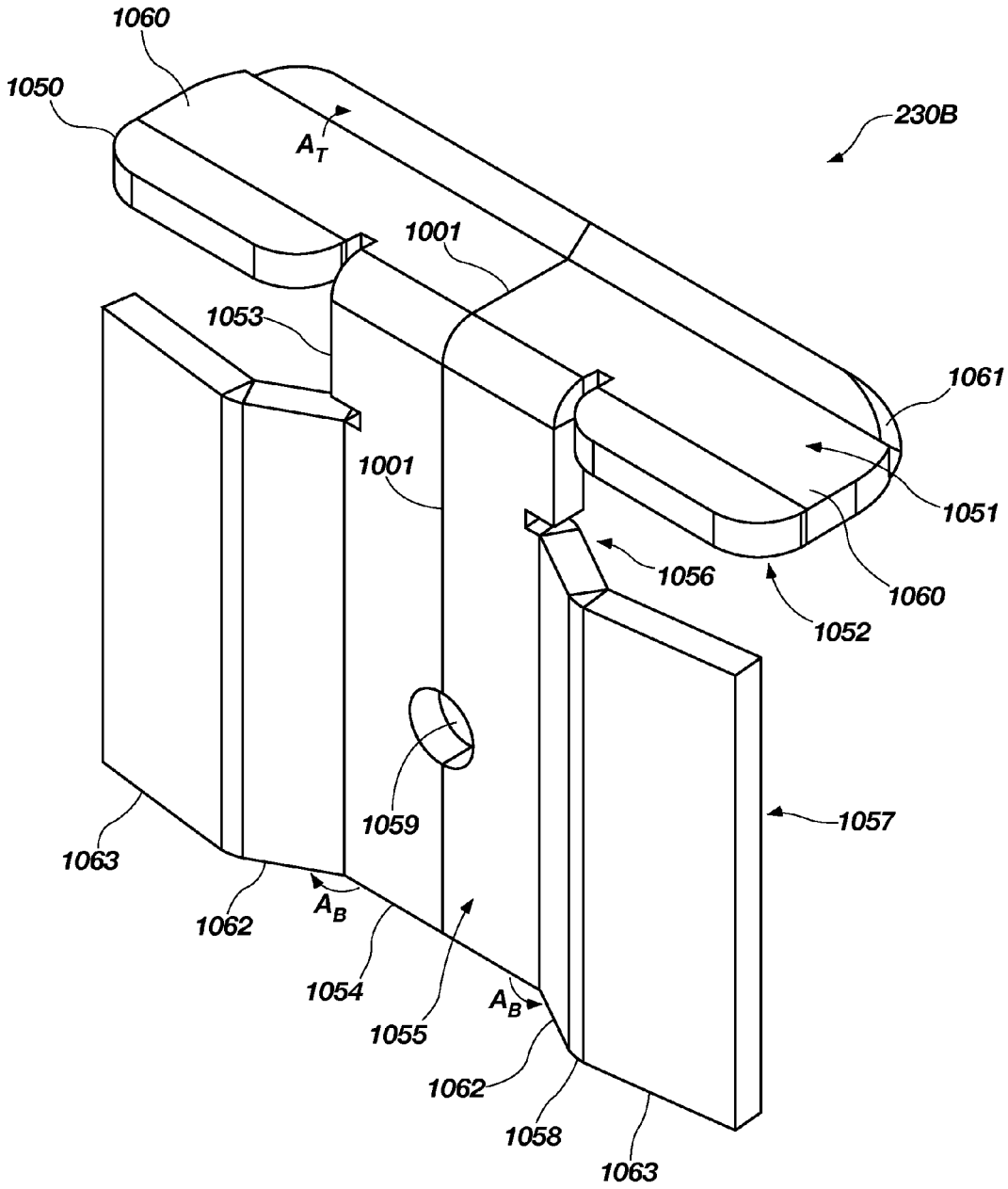
FIG. 10 is a perspective view of a retention clip according to another embodiment of the present disclosure.

FIGS. 9 and 10 are perspective views of the retention clips 230 referred to briefly with respect to FIG. 2, although many of the details of the retention clips 230 were hidden from view in FIG. 2. The retention clips 230 may be configured and located in a movable partition system to prevent undesired separation of adjacent and adjoining panels 104. The adjoining panels 104 may be those described with reference to FIGS. 2 through 8. Of course, embodiments of the present disclosure may include retention clips 230 that are configured to connect to, and prevent separation of, other types of panels of movable partition systems, including panels that include hinge members. Examples of some of the panels to which retention clips 230 may be configured to connect, include those panels described in co-pending U.S. patent application Ser. No. 12/712,922, filed Feb. 25, 2010, now U.S. Pat. No. 8,376,020. and entitled "Folding Partitions Having Adjoining Panels and Related Methods," the entire disclosure of which is incorporated herein by this reference.

In order to accomplish such prevention of separation of adjoining panels, there may be at least two different styles of the retention clips 230. For example, FIG. 9 shows a first retention clip 230A, and FIG. 10 shows a second retention clip 230B. For convenience, the first retention clip 230A and the second retention clip 230B may be collectively referred to as retention clips 230A, 230B. Retention clips 230A, 230B may be configured for connecting to a panel of a movable partition.

Referring now specifically to FIG. 9, the first retention clip 230A may comprise a top portion 950, a base portion 954 connected by a neck portion 953 therebetween. The top portion 950 includes an elongate member having a top surface 951 and a bottom surface 952. The base portion 954 includes an elongate member having a front surface 955, a back surface 956, and a side surface 957. The elongate members of the top portion 950 and the base portion 954 may be extending at least substantially orthogonal relative to one another. The top portion 950 may further include at least one overhang portion 960 (e.g., including a first flange and a second flange) extending outwardly from the neck portion 953 in a transverse direction. The top portion 950 may further include a reinforcement portion 961 extending along the length of the top portion 950. The reinforcement portion 961 may extend at an angle (AT) relative to the top surface near the back of the top portion 950. For example, the angle (AT) may be about 90 degrees, an acute angle, or an obtuse angle. An acute angle is defined herein as being an angle relative two objects that is between 0 degrees and 90 degrees, not including the endpoints. An obtuse angle is defined herein as being an angle relative two objects that is between 90 degrees and 180 degrees, not including the endpoints. 0 degrees and 180 degrees are considered to be parallel to a surface, such that the surface is not angled. For this reason, 0 degrees and 180 degrees are not considered to be angles for purposes of this disclosure. Thus, the angle (AT) may be any angle relative the top surface of the top portion 950 that is not parallel to the top surface of the top portion 950. In some embodiments, the reinforcement portion 961 may extend from the top surface 951 at a gradual angle such that the thickness of the top portion 950 may gradually increase toward the back of the top portion 950, rather than a discrete angle being formed.

The base portion 954 may further include at least one extended side portion 958 extending at an angle (AB) relative the front surface 955 of the base portion 954, such as at an angle (AB) of approximately 90 degrees from the front surface 955. As a result, the length of the top portion 950 may have a greater dimension than the width of the base portion 954. In other words, the base portion 954 may not extend underneath the at least one overhang portion 960 of the top portion 950, such that when viewed from the front, the first retention clip 230A may resemble a "T" shape if two overhang portions 960 (e.g., including a first flange and a second flange) are present, as shown in FIG. 9.

The terms "top" and "base" as well as other terms such as "bottom," "upper," "lower," "side," "front," "back" and other similar terms are not intended to indicate a particular meaning other than a relative orientation of the components if oriented as shown in the illustrated figures. For example, it is recognized that the first retention clip 230A may be connected to a top portion of the sheet of panels 104 or the bottom portion of the sheet of panels 104. As such, the top portion 950 of the first retention clip 230A may be oriented above the base portion 954 of the first retention clip 230A if the first retention clip 230A is connected to the top portion of the sheet of panels 104, while the top portion 950 of the first retention clip 230A may be oriented below the base portion 954 of the retention clip if the first retention clip 230A is connected to the bottom portion of the panel. Similar designations of relative spatial orientation are made with reference to the second retention clip 230B of FIG. 10 for the same purpose.

If the first retention clip 230A is connected to a panel, the back side 956 of the base portion 954 may abut with one of the first major surface or the second major surface of the panel (e.g., surfaces 452, 454 of second panel 104B in FIG. 4) to attach to the sheet of panels 104. For example, the base portion 954 of the first retention clip 230A may include one or more apertures 959 that extend therethrough to facilitate attachment of the first retention clip 230A to the panel using, for example, one or more rivets, bolts, screws, or other fasteners. In some embodiments, the area defining the aperture 959 may be threaded. In additional embodiments, the first retention clip 230A may be welded to a panel, or connected to a panel using an adhesive.

The base portion 954 of the first retention clip 230A may be configured such that the side surface 957 of the base portion 954 is proximate an interface between adjacent panels in order to restrict relative movement of adjacent panels such that separation of adjacent panels may be prevented. For example, the base portion 954 of the first retention clip 230A may be connected to a panel such that if a force is applied to one or more of the panels, the side surface 957 of the base portion 954 abuts against at least one of the adjacent panels and maintains the panels being connected to each other before separation can occur in the transverse direction. The at least one extended side portion 958 may increase the area of the side surface 957 of the base portion 954 that abuts the panel at an interface of adjacent panels and provide more surface area for the panel to contact. The extended side portion 958 may also provided additional strength to the side surface 957 to better withstand a force applied thereto.

The top portion 950 of the first retention clip 230A may be configured such that the bottom surface 952 of the overhang portion 960 is proximate the top of the panels 104 at an interface between adjoining panels. The overhang portion 960 restricts relative movement of the panels 104 in the vertical direction. For example, if a force is applied to the panels, the bottom surface 952 of the overhang portion 960 of the top portion 950 abuts against at least one of the adjacent panels and maintains the panels being connected to each other before separation can occur in the vertical direction. As the first retention clip 230A may be connected proximate a top location or a bottom location of the interface between adjacent panels of a sheet of panels 104, and the first retention clip 230A may be oriented such that the bottom surface 952 may abut against either the top or the bottom of at least one of the adjacent panels before separation occurs. As a result, relative movement of the adjacent panels may be restricted in the vertical direction to a force that is upward or downward depending on the location of the first retention clip 230A.

While FIG. 9 shows that the first retention clip 230A includes two extended side portions 958 and two overhang portions 960, some embodiments of first retention clip 230A may include only one extended side portion 958 or only one extended overhang portion 960. The first retention clip 230A may be formed symmetrically, for example, for convenience of having a single configuration for ease of manufacturing because an interface between adjacent panels may be on either the left or the right of the first retention clip 230A depending on the location for connection on the sheet of panels. As a result, the top portion 950 and the base portion 954 may be symmetrical along a vertical axis of symmetry 901.

Referring now to FIG. 10, the second retention clip 230B may comprise a top portion 1050, and a base portion 1054 connected by a neck portion 1053 therebetween. The top portion 1050 includes an elongate member having a top surface 1051 and a bottom surface 1052. The base portion 1054 includes an elongate member having a front surface 1055 and a back surface 1056. The elongate members of the top portion 1050 and the base portion 1054 may be extending at least substantially orthogonal relative to one another. The top portion 1050 may further include at least one overhang portion 1060 extending outwardly from the neck portion 1053 in a transverse direction. The top portion 1050 may further include a reinforcement portion 1061 extending along the length of the top portion 1050. The reinforcement portion 1061 may extend from the back of the top portion 1050 at an angle ($A_T$) (e.g., 90 degrees, an obtuse angle, etc.). In some embodiments, the reinforcement portion 1061 may extend from the top surface 1051 at a gradual angle such that the thickness of the top portion 1050 may gradually increase toward the back of the top portion 1050, rather than a discrete angle being formed.

The base portion 1054 may further include at least one extended side portion 1058 extending outwardly from the front surface 1055 of the base portion 1054 as at an angle ($A_B$) from the front surface 1055, which may be 90 degrees or more (e.g., greater than or equal to 90 degrees and less than 180 degrees), and the extended side portion 1058 may further extend in a lateral direction. For example, the extended side portion 1058 may include an angular portion 1062 and a lateral portion 1063. The lateral portion 1063 of the extended side portion 1058 may extend parallel to the base portion 1054, or in some embodiments, there may be a slight angle therebetween. In other words, the angle $A_B$ may be an obtuse angle before the extended side portion 1058 further extends laterally in approximately the same general direction as the base portion 1054. In some embodiments, the angle ($A_B$) may be approximately 90 degrees before the extended side portion 1058 further extends laterally. With the extended side portion 1058 extending further laterally, the width of the base portion 1054 may be approximately equal to the length of the top portion 1050. With the extended side portion 1058 first extending from the front surface 1055 from an angle $A_B$ and then extending laterally, the base portion 1054 may not extend underneath the at least one overhang portion 1060 of the top portion 1050, which may provide an area for the portions of panels at the interface of the adjacent panels to fit.

If the second retention clip 230B is connected to a panel, the back surface 1056 of the base portion 1054 may abut with one of the first major surface or the second major surface of the panel (e.g., surfaces 452, 454 of second panel 104B in FIG. 4) to attach to the sheet of panels 104. For example, the base portion 1054 of the second retention clip 230B may include one or more apertures 1059 that extend therethrough to facilitate attachment of the second retention clip 230B to the panel using, for example, one or more rivets, bolts, screws, or other fasteners. In some embodiments, the area defining the aperture 1059 may be threaded. In additional embodiments, the second retention clip 230B may be welded to a panel, or connected to a panel using an adhesive.

The base portion 1054 of the second retention clip 230B may be configured such that the side surface 1057 of the base portion 1054 is proximate an interface between adjacent panels in order to restrict relative movement of adjacent panels such that separation of adjacent panels may be prevented. For example, the base portion 1054 of the second retention clip 230B may be connected to a panel such that if a force is applied to one or more of the panels, the side surface 1057 of the base portion 1054 abuts against at least one of the adjacent panels and maintains the panels being connected to each other before separation can occur in the transverse direction. The at least one extended side portion 1058 may increase the area of the side surface 1057 of the base portion 1054 that abuts the panel at an interface of adjacent panels and provide more surface area for the panel to contact. The extended side portion 1058 may also provided additional strength to the side surface 1057 to better withstand a force applied thereto.

The top portion 1050 of the second retention clip 230B may be configured such that the bottom surface 1052 of the overhang portion 1060 is proximate the top of the panels 104 at the interface between adjoining panels. The overhang portion 1060 restricts relative movement of the panels 104 in the vertical direction. For example, if a force is applied to the panels, the bottom surface 1052 of the overhang portion 1060 of the top portion 1050 abuts against at least one of the adjacent panels and maintains the panels being connected to each other before separation can occur in the vertical direction. As the second retention clip 230B may be connected proximate a top location or a bottom location of the interface between adjacent panels of the sheet of panels 104, and the second retention clip 230B may be oriented such that the bottom surface 1052 may abut against either the top or the bottom of at least one of the adjacent panels before separation occurs. As a result, relative movement of the adjacent panels may be restricted in the vertical direction to a force that is upward or downward depending on the location of the second retention clip 230B.

While FIG. 10 shows that the second retention clip 230B includes two extended side portions 1058, and two overhang portions 1060, some embodiments of second retention clip 230B may include only one extended side portion 1058 or only one extended overhang portion 1060. The second retention clip 230B may be fowled symmetrically, for example, for convenience of having a single configuration for ease of manufacturing because an interface between adjacent panels may be on either the left or the right of the second retention clip 230B depending on the location on the sheet of panels. As a result, the top portion 1050 and the base portion 1054 may be symmetrical along a vertical axis of symmetry 1001. In some embodiments, a retention clip may include a first side surface similar to that of FIG. 9 and second side surface similar to that of FIG. 10.

Referring now to both FIGS. 9 and 10, the respective top portions 950, 1050, base portions 954, 1054, and the neck portions 953, 1053 of the retention clips 230A, 230B may be integrally formed with one another as a single structure, or in other words, they may comprise portions of an integral monolithic structure. In some embodiments, the top portions 950, 1050, base portions 954, 1054, and/or the neck portions 953, 1053 may comprise discrete bodies that are bonded or otherwise connected together. In addition, while the neck portions 953, 1053 are shown to have gaps formed therein, such gaps may not exist such that the neck portions 953, 1053 have a continuous transition with the respective top portions 950, 1050 and the base portions 954, 1054. In some embodiments, the neck portions 953, 1053 may not exist in additional embodiments, such that the base portions 954, 1054 are connected directly to the top portions 950, 1050 of the respective retention clip 230A, 230B. The existence of the neck portions 953, 1053 may provide some clearance to the top of the interface between adjacent panels.

The retention clips 230A, 230B may be manufactured from and comprise materials such as polymeric materials, composite materials, and metal materials. As non-limiting examples, the retention clips 230A, 230B may be manufactured from and comprise a polymeric material such as an acrylonitrile butadiene styrene (ABS) material or a polyvinyl chloride (PVC) material. Such polymer materials also may include a filler material such as, for example, glass particles (e.g., whiskers). In additional embodiments, the retention clips 230A, 230B may comprise a metal material such as, for example, aluminum, an aluminum-based alloy material, iron, or an iron-based alloy material.

The retention clips 230A, 230B may be manufactured using a molding process such as, for example, an injection molding process. In an injection molding process, a mold may be formed that includes a mold cavity having a geometry complementary to that of the retention clips 230A, 230B such that the retention clips 230A, 230B may be formed by injecting material into the mold cavity. The mold may comprise a plurality of mold parts (e.g., two mold halves), and recesses may be formed into the adjoining surfaces of the mold parts such that the mold cavity is defined by the recess surfaces in the various mold parts when they are assembled together. The mold cavity may be shaped to form the retention clips 230A, 230B. In other words, the mold cavity within the mold may be shaped to include a portion corresponding to the base portion 954, 1054, another portion corresponding to the top portion 950, 1050, and another portion corresponding to the neck portion 953, 1053 of the retention clip 230A, 230B. After shaping the mold cavity, material (e.g., a molten polymer material) may be injected into the mold cavity to form the retention clip 230A, 230B. Injection molding systems suitable for use in forming embodiments of retention clips 230A, 230B of the present disclosure are commercially available. In another embodiment, the retention clips 230A, 230B may be manufactured from a material (e.g., steel) that is bent (e.g., stamped) into the appropriate shape. It is contemplated that other methods may be implemented to form the retention clips 230A, 230B according to methods known in the art.

Figure 11:
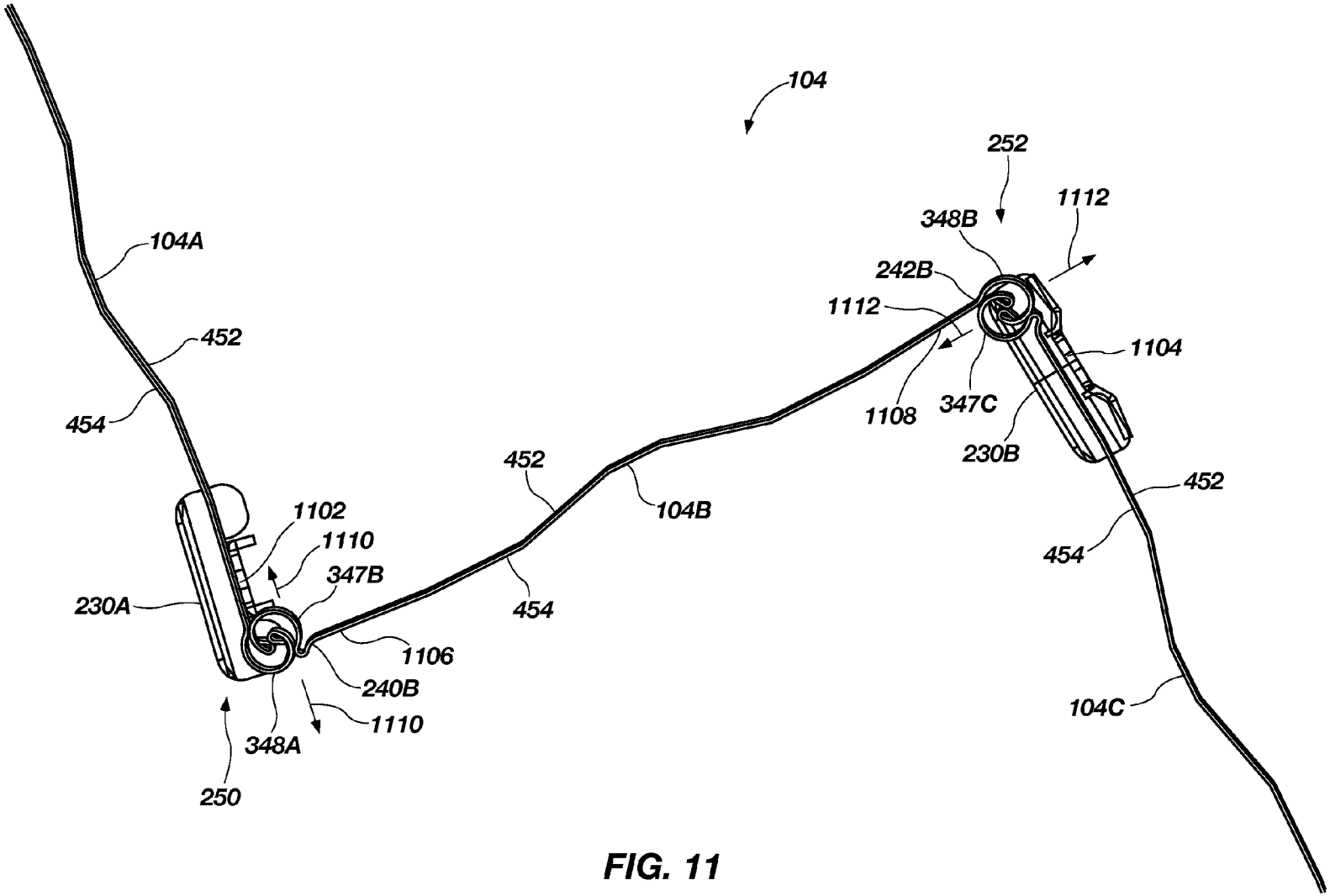
FIG. 11 is a top view of the portion of the sheet of panels of FIG. 2 in a partially retracted state with retention clips mounted thereon.

FIG. 11 is a top view of the portion of the sheet of panels 104 of FIG. 2 in a partially retracted state with retention clips 230A, 230B mounted thereon. The retention clips 230A, 230B are shown in FIG. 11 as being transparent in order to show alignment with the respective panels 104A, 104B, and 104C. For example, the first retention clip 230A is connected to the first panel 104A proximate the top location 250 of the interface between the first panel 104A and the second panel 104B, and the second retention clip 230B is connected to the third panel 104C proximate the top location 252 of the interface between the second panel 104B and the third panel 104C. In particular, the first retention clip 230A is connected to the first major surface 452 of the first panel 104A at location 1102, and the second retention clip 230B is connected to the first major surface 452 of the third panel 104C at location 1104. As a result, the side surface of the base portion of the first retention clip 230A may restrict the relative movement of the first panel 104A and the second panel 104B from separating in the vertical direction 1110. In addition, the side surface of the base portion of the second retention clip 230B may restrict the relative movement of the second panel 104B and the third panel 104C from separating in a transverse direction 1112.

Instead of the first retention clip 230A, another second retention clip 230B may be connected to the second major surface 454 of the second panel 104B proximate the top location 250 of the interface, for example approximately at location 1106. As a result, the another second retention clip 230B may restrain the relative movement of the first panel 104A and the second panel 104B from separating in the transverse direction 1110. If the another second retention clip 230B is connected to the second panel 104B, the base portions of the corresponding retention clips may be visible on both major surfaces 452, 454 of the sheet of panels 104.

Similarly, instead of the second retention clip 230B, another first retention clip 230A may be connected to the second major surface 454 of the second panel 104B proximate the top location 252 of the interface, for example, approximately at location 1108. As a result, the another first retention clip 230A may restrain the relative movement of the second panel 104B and the third panel 104C from separating in the transverse direction 1112. If the another first retention clip 230A is connected to the second panel 104B, the base portions of the corresponding retention clips may be visible on both major surfaces 452, 454 of the sheet of panels 104.

In order to have the retention clips 230 connected on a common major surface of the sheet of panels 104, the first retention clip 230A and the second retention clip 230B may alternate along the common major surface of the sheet of panels 104. Other embodiments may include retention clips 230A, 230B at each of locations 1102, 1104, 1106, and 1108.

As a result, a method for restricting relative movement between adjacent panels 104 of a movable partition 102 may be provided. The method may include connecting the first retention clip 230A having an extended side portion 958 extend at an angle from a base portion 954 proximate a first interface between a pair adjacent panels 104. The extended side portion 958 may restrict movement of the pair of adjacent panels 104 in a transverse direction. The method may further include connecting a second retention clip 230B having an extended side portion 1058 extend at an angle from a base portion proximate a second interface between another pair of adjacent panels 104. The extended side portion 1058 may restrict movement of the another pair of adjacent panels in the transverse direction.

Connecting the first retention clip 230A may include positioning a top portion of the first retention clip 230A proximate one of a top location and a bottom location of the first interface to restrict relative movement in the vertical direction between the pair of adjacent panels 104. Connecting the first retention clip 230A and the second retention clip 230B may further include connecting the base portions of the first retention clip 230A and the second retention clip 230B to a common major surface of the movable partition 102. Connecting the first retention clip 230A and the second retention clip 230B may further include connecting a plurality of retention clips along a movable partition 102 in an alternating fashion that are similar to the first retention clip 230A and the second retention clip 230B.

FIG. 12 is a side view of the portion of a sheet of panels 104 of FIG. 2 in an extended state with retention clips 230A, 230B mounted thereon. In contrast with FIG. 2, FIG. 12 shows the sheet of panels 104 from the other side of the sheet of panels 104. FIG. 12 further shows that the top portions 950, 1050 of the respective retention clips 230A, 230B may be positioned proximate locations 250, 252, 254, 256 of the interfaces between adjacent panels 104, such that the relative movement of the panels 104 may be restricted in a vertical direction 1210. As discussed with respect to FIG. 11, the retention clips 230A, 230B alternate along the panels 104A, 104B, 104C, such that the base portions 954, 1054 of the respective retention clips 230A, 230B are connected to a common major surface of the sheet of panels 104. For example, this view of the sheet of panels 104 may be an inner side of the sheet of panels 104 of the movable partition system 100 (FIG. 1), such that the base portions 954, 1054 of retention clips 230A, 230B are not visible on the outer side of the sheet of panels 104.

FIG. 12 further shows a plurality of profile clips 1250 connected to the sheet of panels 104. The profile clips 1250 may be connected to the second panel 104B proximate the top and bottom of the second panel 104B. The profile clips 1250 may be connected to the second panel 1250 to maintain the position of a sweep material (not shown) connected between the profile clips 1250 and the corresponding panel along the length of the sheet of panels 104. The sweep material may also be connected between the sheet of panels 104 and the corresponding first clip 230A and second clip 230B, as well as between the sheet of panels 104 and the roller assemblies 216 (FIG. 2). The sweep material may be provided along the top and bottom portions of the movable partition system to establish a seal with the track or the floor for fire safety, smoke safety, etc.

Figure 13:
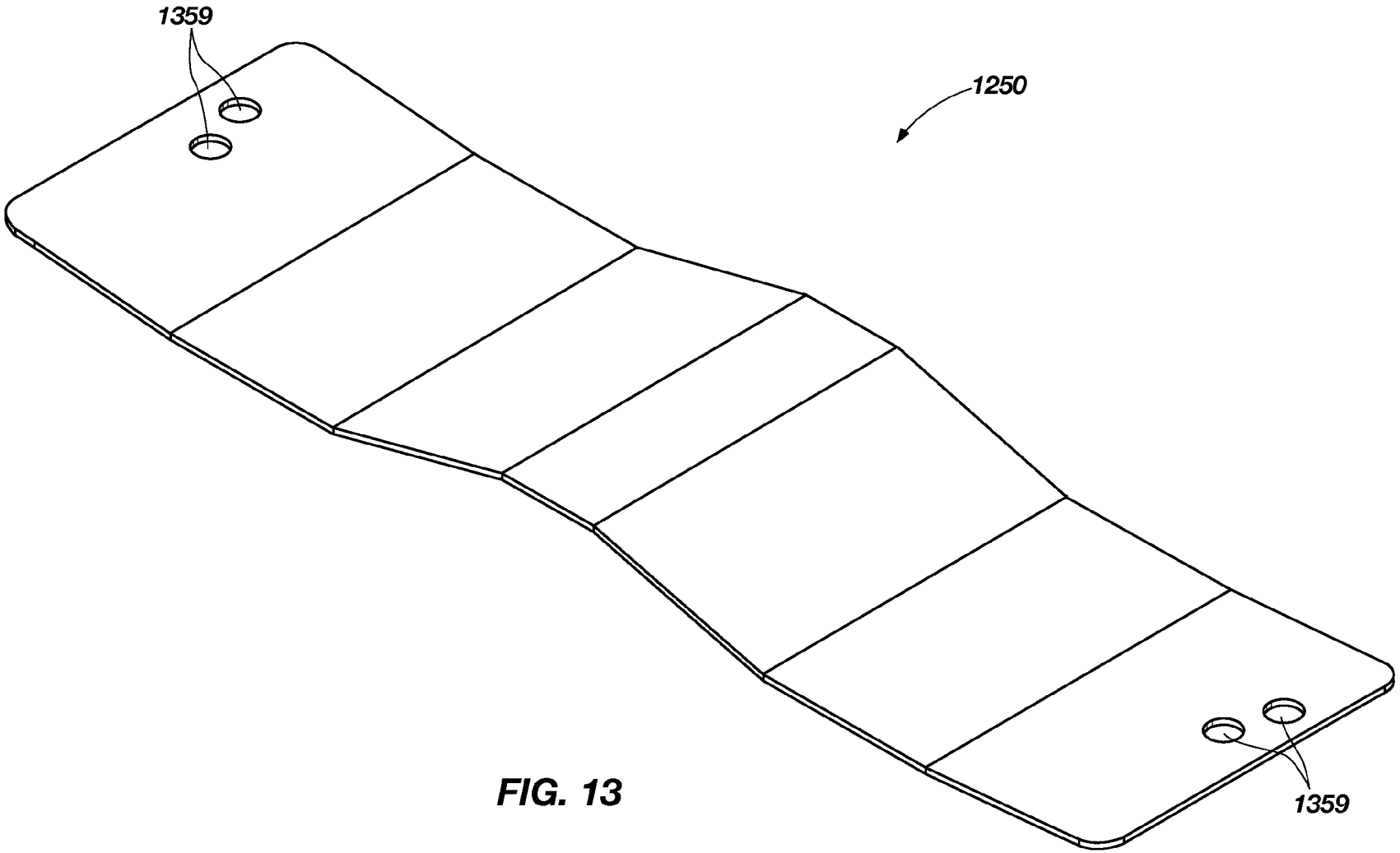
FIG. 13 is a perspective view of a profile clip shown in FIG. 12.

FIG. 13 is a perspective view of the profile clip 1250 shown in FIG. 12. The profile clip 1250 may have a shape that follows the shape of the panel (e.g., second panel 104B of FIG. 12). The profile clip 1250 includes apertures 1359 that are positioned to align with apertures in the sheet of panels 104 in order to connect the profile clip 1250 thereto, such as through the use of an appropriate fastener.

CONCLUSION

In some embodiments, a retention clip for connecting to a panel of a movable partition is disclosed. The retention clip comprises a top portion and a base portion. The top portion includes an elongated member having a top surface and a bottom surface. The base portion includes an elongated member having a front surface, a back surface, and a side surface. The top portion and the base portion may extend approximately orthogonal to one another. The base portion further includes an extended side portion extending at an angle relative to the front surface.

In additional embodiments, a movable partition system is disclosed. The movable partition system comprises a plurality of interconnected panels configured to extend to an extended state and to fold to a retracted state. The plurality of interconnected panels comprises a first panel, a second panel connected to the first panel at a first interface, and a third panel connected to the second panel at a second interface. The movable partition system further comprises a first retention clip connected to one of the plurality of interconnected panels proximate the first interface. The first retention clip includes a base portion having an extended side portion that extends at an angle relative its base portion. The extended side portion of the first retention clip restricts relative movement of the first panel and the second panel in a transverse direction. The movable partition system further comprises a second retention clip connected to one of the plurality of interconnected panels proximate the second interface. The second retention clip includes a base portion having an extended side portion that extends at an angle relative its base portion. The extended side portion of the second retention clip restricts relative movement of the second panel and the third panel in the transverse direction.

In yet further embodiments, a method for restricting relative movement of adjacent panels of a movable partition is disclosed. The method comprises connecting a first retention clip having an extended side portion extending at an angle from a base portion proximate a first interface between a pair of adjacent panels. The extended side portion may restrict movement of the pair of adjacent panels in a transverse direction. The method further comprises connecting a second retention clip having an extended side portion extending at an angle from a base portion proximate a second interface between another pair of adjacent panels. The extended side portion may restrict movement of the another pair of adjacent panels in the transverse direction.

While the invention may be susceptible to various modifications and alternative fauns, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A retention clip for connecting to a panel of a movable partition, the retention clip comprising:

a top portion including an elongated member having a top surface and a bottom surface; and a base portion including an elongated member having a front surface, a back surface, and a side surface, the top portion extending outwardly from the back surface of the base portion and approximately orthogonal to the base portion, wherein the base portion further includes an extended side portion extending outwardly from the front surface at an angle that is approximately 90 degrees relative to the front surface and further extending along the base portion in a direction approximately orthogonal to the top portion, wherein the top portion comprises an overhang portion comprising a first flange and a second flange, each of the first flange and the second flange extending beyond the front surface in substantially a same direction as a direction in which the extended side portion extends from the front surface.

2. The retention clip of claim 1, wherein the top portion and the base portion are connected together by a neck portion therebetween.

3. The retention clip of claim 1, wherein the top portion and the base portion are symmetrical along a vertical axis of symmetry.

4. The retention clip of claim 1, wherein the top portion and the base portion are integrally formed as a single structure.

5. The retention clip of claim 1, wherein the top portion includes a reinforcement portion that extends outwardly from the top surface along a back portion of the top portion at an angle relative the top surface of the top portion.

6. A movable partition system, comprising:

a plurality of interconnected panels configured to extend to an extended state and to fold to a retracted state, the plurality of interconnected panels comprising:

a first panel;

a second panel connected to the first panel at a first interface; and a third panel connected to the second panel at a second interface;

a first retention clip connected to one of the plurality of interconnected panels proximate the first interface, the first retention clip including a top portion and a base portion, the base portion including an elongated member having a front surface, a back surface, a side surface, and an extended side portion that extends outwardly from the front surface at an angle relative to the front surface, wherein the base portion of the first retention clip is connected to a major surface of one of the first panel and the second panel such that the extended side portion of the first retention clip extends outwardly from the major surface and abuts an outer surface of the first interface such that relative movement of the first panel and the second panel is restricted in a transverse direction, and wherein the top portion extends outwardly from the back surface of its corresponding base portion and extends across a first surface of the first panel and the second panel at the first interface, the first surface being in a plane that is orthogonal to the major surface, wherein the top portion of the first retention clip restricts relative movement of the first panel and the second panel in a vertical direction; and a second retention clip connected to one of the plurality of interconnected panels proximate the second interface, the second retention clip including a top portion and a base portion, the base portion including an elongated member having a front surface, a back surface, a side surface, and an extended side portion that extends outwardly from the front surface at an angle relative the front surface, wherein the base portion of the first retention clip is connected to a major surface of one of the second panel and the third panel such that the extended side portion of the second retention clip extends outwardly from the major surface and abuts an outer surface of the second interface such that relative movement of the second panel and the third panel is restricted in the transverse direction, and wherein the top portion extends outwardly from the back surface of its corresponding base portion and extends across a second surface of the second panel and the third panel at the second interface, the second surface being in a plane that is orthogonal to the major surface, wherein the top portion of the second retention clip restricts relative movement of the second panel and the third panel in the vertical direction.

7. The movable partition system of claim 6, wherein the angle relative to the front surface of the first retention clip is approximately 90 degrees.

8. The movable partition system of claim 7, wherein the angle relative to the front surface of the second retention clip is between about 90 degrees and about 180 degrees, and wherein the extended side portion further extends laterally in a direction at least substantially parallel to the base portion.

9. The movable partition system of claim 6, wherein the base portion of the first retention clip and the base portion of the second retention clip connect to different panels of the plurality of interconnected panels.

10. The movable partition system of claim 9, wherein the base portion of the first retention clip and the base portion of the second retention clip are connected to a common major surface of the plurality of interconnected panels.

11. The movable partition system of claim 6, wherein the base portion of the first retention clip and the base portion of the second retention clip are connected to a common panel of the plurality of interconnected panels.

12. The movable partition system of claim 6, wherein the first retention clip and the second retention clip are each connected to its corresponding panel of the plurality of interconnected panels with a fastener extending through an aperture of the base portion to an aperture in its corresponding panel of the plurality of interconnected panels.

13. A movable partition system, comprising:

a plurality of interconnected panels configured to extend to an extended state and to fold to a retracted state, the plurality of interconnected panels comprising:

a first panel;

a second panel connected to the first panel at a first interface; and a third panel connected to the second panel at a second interface;

a first retention clip connected to one of the plurality of interconnected panels proximate the first interface, the first retention clip including a base portion including an elongated member having a front surface, a back surface, a side surface, and an extended side portion that extends outwardly from the front surface of its base portion at a first angle, wherein the extended side portion of the first retention clip restricts relative movement of the first panel and the second panel in a transverse direction; and a second retention clip connected to one of the plurality of interconnected panels proximate the second interface, the second retention clip including a base portion including an elongated member having a front surface, a back surface, a side surface, and an extended side portion that extends outwardly from the front surface of its base portion at a second angle that is different than the first angle, wherein the extended side portion of the second retention clip restricts relative movement of the second panel and the third panel in the transverse direction;

wherein the base portion of the first retention clip and the base portion of the second retention clip connect to different panels of the plurality of interconnected panels; and wherein the base portion of the first retention clip and the base portion of the second retention clip abut on a common major surface of the plurality of interconnected panels.

14. The movable partition system of claim 13, wherein:

the extended side portion of the first retention clip abuts against the first interface in the extended state and wherein the first approximately 90 degrees; and the extended side portion of the second retention clip extends laterally across the second interface in the extended state and wherein the second angle is between about 90 and about 180 degrees.

15. The movable partition system of claim 13, wherein:

the first retention clip includes a top portion extending outwardly from the back surface of its corresponding base portion, wherein the top portion extends across a first surface of the first panel and the second panel at the first interface, the first surface being in a plane that is orthogonal to the common major surface, wherein the top portion of the first retention clip restricts relative movement of the first panel and the second panel in a vertical direction; and the second retention clip includes a top portion extending outwardly from the back surface of its corresponding base portion, wherein the top portion extends across a second surface of the second panel and the third panel at the second interface, the second surface being in a plane that is orthogonal to the common major surface, wherein the top portion of the second retention clip restricts relative movement of the second panel and the third panel in the vertical direction.

16. The movable partition system of claim 15, wherein the top portion of at least one of the first retention clip and the second retention clip includes a reinforcement portion extending along a top surface of the back portion at an angle relative the top surface.

17. The movable partition system of claim 15, wherein the first retention clip is positioned proximate a bottom location of the first interface of the plurality of interconnected panels such that its corresponding top portion abuts the first surface of the first panel and the second panel and restricts relative movement of the corresponding panels in the vertical direction to a force that is downward.

18. A movable partition system, comprising:

a plurality of interconnected panels configured to extend to an extended state and to fold to a retracted state, the plurality of interconnected panels comprising:

a first panel;

a second panel connected to the first panel at a first interface; and a third panel connected to the second panel at a second interface;

a first retention clip connected to one of the plurality of interconnected panels proximate the first interface, the first retention clip including a base portion having an extended side portion that extends at an angle relative its base portion, wherein the extended side portion of the first retention clip restricts relative movement of the first panel and the second panel in a transverse direction; and a second retention clip connected to one of the plurality of interconnected panels proximate the second interface, the second retention clip including a base portion having an extended side portion that extends at an angle relative its base portion, wherein the extended side portion of the second retention clip restricts relative movement of the second panel and the third panel in the transverse direction;

wherein the first retention clip and the second retention clip are each connected to its corresponding panel of the plurality of interconnected panels with a fastener extending through an aperture of the base portion to an aperture in its corresponding panel of the plurality of interconnected panels; and wherein the aperture of the first retention clip and the aperture of the second retention clip are offset, such that fasteners of neighboring panels are not aligned when the movable partition is in the retracted state.

19. A method for restricting relative movement between adjacent panels of a movable partition, the method comprising:

connecting a first retention clip proximate a first interface between a pair of adjacent panels, the first retention clip having a base portion including an elongated member having a front surface, a back surface, a side surface, and an extended side portion extending outwardly from the front surface at a first angle from the front surface of its base portion, the extended side portion abutting an outer surface of the first interface such that movement of the pair of adjacent panels is restricted in a transverse direction; and connecting a second retention clip proximate a second interface between another pair of adjacent panels, the second retention clip having a base portion including an elongated member having a front surface, a back surface, a side surface, and an extended side portion extending outwardly from the front surface at a second angle from the front surface of its base portion, the extended side portion abutting an outer surface of the second interface such that movement of the another pair of adjacent panels is restricted in the transverse direction, wherein the first angle and the second angle are different.

20. The method of claim 19, wherein connecting the first retention clip includes positioning a top portion of the first retention clip over one of a top location and a bottom location of the first interface to restrict relative movement in the vertical direction between the pair of adjacent panels, wherein the top location and the bottom location are in planes that are orthogonal with a major surface of the movable partition to which the base portion of the first retention clip is connected.

21. The method of claim 19, wherein connecting the first retention clip and the second retention clip includes connecting the base portions of the first retention clip and the second retention clip to a common major surface of the movable partition.

22. The method of claim 19, further comprising:

connecting a plurality of first retention clips that are at least substantially identical to the first retention clip; and connecting a plurality of second retention clips that are at least substantially identical to the second retention clip, wherein the first retention clips and the second retention clips are connected to panels of the movable partition in an alternating fashion along the movable partition.

* * * * *